US006263840B1

(12) United States Patent
Avramidis

(10) Patent No.: US 6,263,840 B1
(45) Date of Patent: Jul. 24, 2001

(54) MOTORBLOCK AND CYLINDERLINER THEREFOR

(76) Inventor: Panagiotis Avramidis, Otto-Hahn-Strasse 2, D-71364, Winnenden (DE)

( * ) Notice: Subject to any disclaimer, the term of this patent is extended or adjusted under 35 U.S.C. 154(b) by 0 days.

(21) Appl. No.: 09/416,349

(22) Filed: Oct. 12, 1999

(30) Foreign Application Priority Data

Oct. 13, 1998 (DE) ..... 198 46 877

(51) Int. Cl.[7] ..... F02F 1/10
(52) U.S. Cl. ..... 123/41.72; 123/41.84
(58) Field of Search ..... 123/41.72, 41.84, 123/41.79, 41.74

(56) References Cited

U.S. PATENT DOCUMENTS 2,635,592 * 4/1953 Hollis ..... 123/41.82
4,616,600 * 10/1986 Hirano ..... 123/41.21
4,846,116 7/1989 Sakurahara et al. .

* cited by examiner

*Primary Examiner*—Willis R. Wolfe
*Assistant Examiner*—Katrina B. Harris
(74) *Attorney, Agent, or Firm*—Kriegsman & Kriegsman

(57) ABSTRACT

The present invention concerns an engine block (1) of a metal material for a multicylinder internal combustion engine, with a housing (2), in which cylinder boreholes (5) are provided, whereby the outer surfaces of side walls (6) of cylinder boreholes (5) are distanced from the wall (3) of housing (2), so that cooling channels (9) arranged between wall (3) and cylinder boreholes (5) result. It is provided according to the invention that cylinder boreholes (5') are shortened such that the height (h2) of the shortened cylinder boreholes (5') is smaller than the height (h1) of the unshortened cylinder boreholes (5). The present invention also concerns a cylinder bushing (10) with a sleeve (11) and a collar (12), whose outer diameter is larger than the outer diameter of sleeve (11).

7 Claims, 3 Drawing Sheets

MOTORBLOCK AND CYLINDERLINER THEREFOR

The present invention concerns an engine block of a metal material for a multicylinder internal combustion engine, with a housing, in which cylinder boreholes are provided, whereby the outer surfaces of the side walls of the cylinder boreholes are distanced from the walls of the housing, so that cooling channels arranged between the walls and the cylinder boreholes result. The present invention also concerns a cylinder bushing for such an engine block as well as a method for the production of such an engine block.

Such engine blocks are known. They are cast in grey castings of iron or light metal, depending on the material used. Then loose cylinder bushings can be utilized in the cylinder boreholes, insofar as these are not already cast with them; their inner walls represent the sliding surfaces for the pistons. The upper side of the side wall of the cylinder borehole serves as the support surface for the cylinder head gasket.

Prefinished cast engines blocks can be post-machined ("tuned up") to increase the engine performance. For this purpose, the cylinder boreholes are re-bored, i.e., their diameter is enlarged. A corresponding enlargement of the [piston] stroke space results from this. Of course, the thickness of the side walls is reduced. It is a problem that the surface of the upper side of the cylinder boreholes and thus the support surface for the cylinder head gaskets is simultaneously reduced. The danger arises that the cylinder head gaskets no longer sit perfectly and no longer can guarantee a sufficient seal after the post-machining.

The object of the present invention consists of producing an engine block or a cylinder bushing of the type named above, which also has a sufficient support surface for the cylinder head gasket after enlarging the stroke space.

The solution consists of the fact that the cylinder boreholes are shortened, so that the height of the shortened cylinder boreholes is smaller than the height of the unshortened cylinder boreholes.

In such an engine block, according to the invention, cylinder bushings can be utilized, which have a sleeve and a collar, the outer diameter of which is larger than the outer diameter of the sleeve. The cylinder bushing is inserted into the shortened cylinder borehole, whereby the underside of the collar sits on the upper side of the side wall. The surface of the collar thus represents the support surface for the cylinder head gasket. Thus a sufficiently large support surface is available for the cylinder head gasket, so that it has a solid support and a perfect seal is assured.

Advantageous further embodiments result from the subclaims. The magnitude of difference between the outer diameter of the collar and sleeve of a cylinder bushing can be larger or the same, but preferably larger, than the magnitude of the wall thickness of the side wall of the assigned cylinder borehole. Thus a maximum support surface is available for the cylinder head gasket.

The engine block according to the invention is produced by metal-cutting [machining], for example, by milling the side walls of the cylinder boreholes of a finished engine block, so that they are shortened. This method is particularly offered for post-machining within the scope of engine tuning, in which, for example, the wall thickness of the side walls of the cylinder boreholes is also reduced. Of course, the engine block according to the invention can also be cast directly in an appropriate shape.

An example of embodiment of the present invention based on the attached drawings is explained in more detail below. Here:

FIG. 1*a* shows a schematic, excerpted perspective representation, not drawn to scale, of a cast engine block prior to machining;

FIG. 1*b* shows a section along line Ib—Ib of FIG. 1*a;*

FIG. 2*a* shows a schematic, excerpted perspective representation, not drawn to scale, of a cast engine block according to the invention after machining;

FIG. 2*b* shows a section along line IIb—IIb in FIG. 2*a;*

Figure 1A:
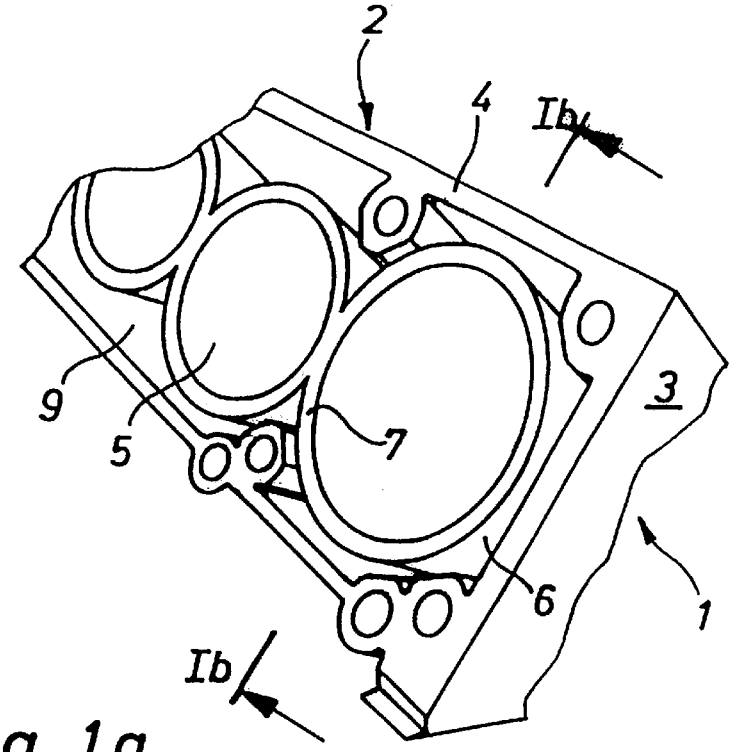
Figure 1B:
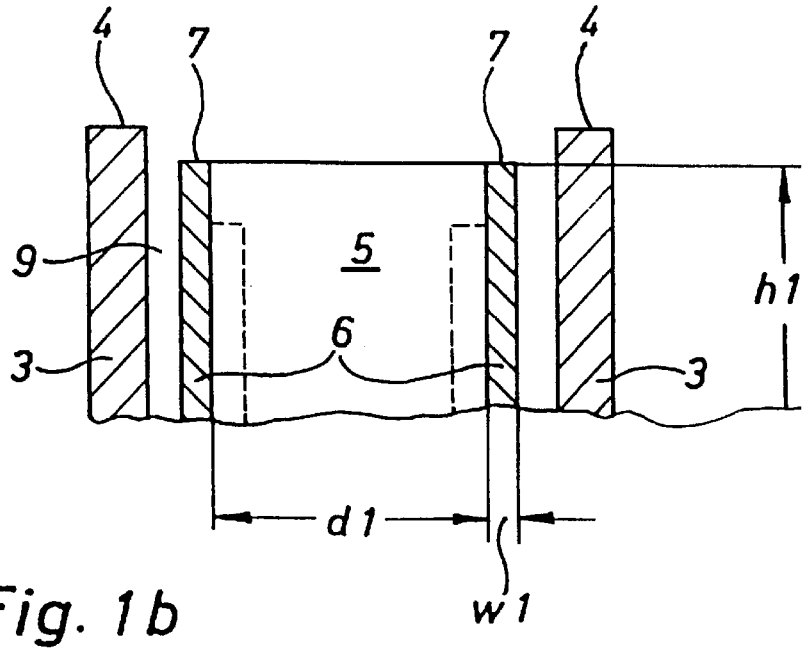

FIG. 1*a* shows schematically and not according to scale a perspective representation of an engine block 1 known in the state of the art. Engine block 1, in the example of embodiment, is a light metal engine block, for example, produced from aluminum in the diecasting process, but it can also be produced from other materials, for example, grey cast iron. It has an essentially rectangular housing 2 with a wall 3. The upper side 4 of wall 3 is smooth and even. Cylinder boreholes 5 with a specific diameter d1 and a specific height h1 made up in one piece with the housing are found inside housing 2 (FIG. 1*b*). The side walls 6 of cylinder boreholes 5 have a specific wall thickness w1. These side walls 6 with wall thickness w1 serve as the support surfaces for cylinder head gaskets. The wall thickness w1 should be large enough in order to assure a sufficient support surface for the cylinder head gaskets, so that they sit perfectly and a sufficient seal is assured. The upper side 7 of side walls 6 are also smooth and even.

The outer surfaces of side walls 6 of cylinder boreholes 5 are arranged at a distance to wall 3 of housing 2. Cooling channels 9, through which cooling fluid is guided in the operation of the engine, result therefrom.

An inserted cylinder bushing 10, is indicated by the dashes in FIG. 1*b*. The cylinder borehole 5 with the inserted cylinder bushing 10 is later closed with a cylinder head (not shown), whereby the cylinder head gasket sits between upper side 7 of side wall 6 and the cylinder head.

Figure 2A:
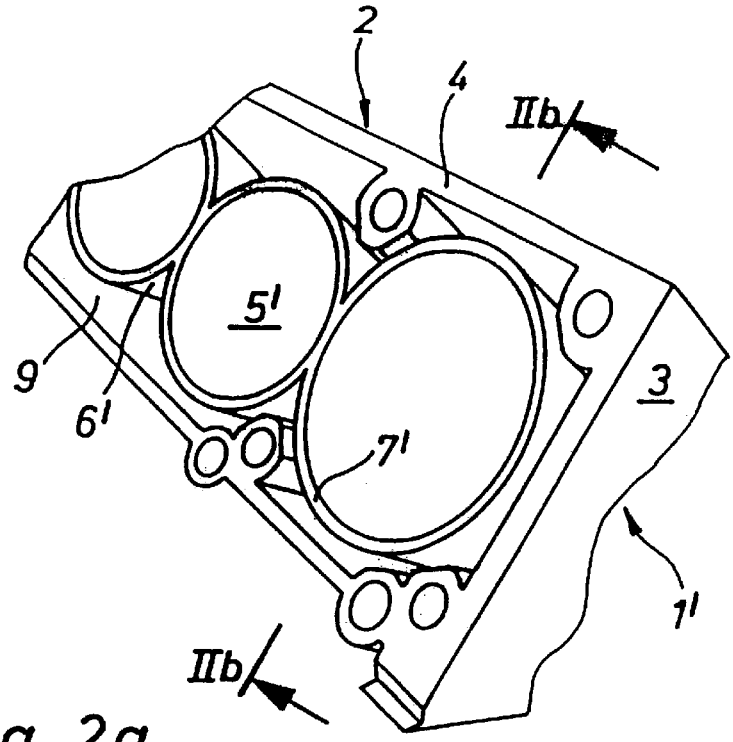
Figure 2B:
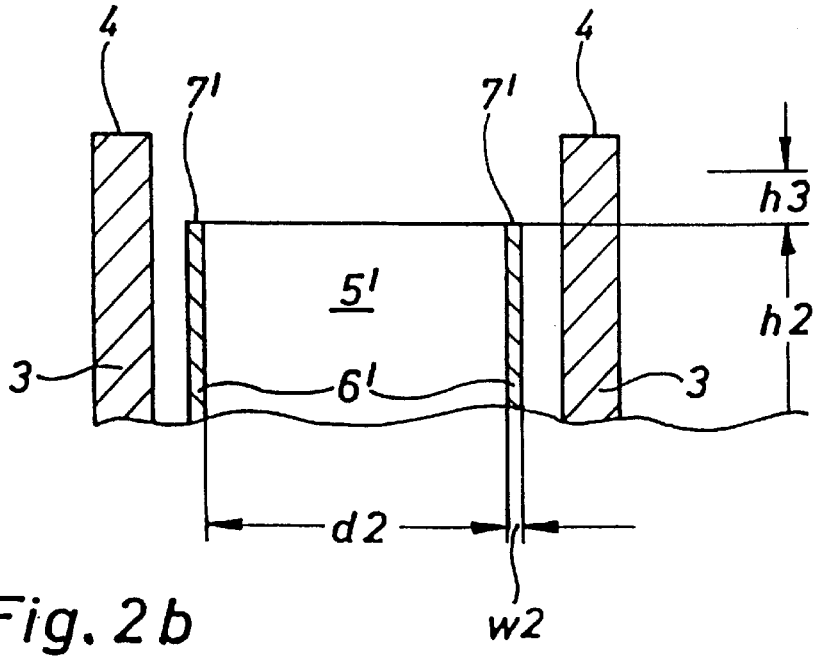

FIG. 2*a* shows also schematically and not according to scale engine block 1' after a machining to improve performance ("tuning up"). The cylinder boreholes 5' were rebored in order to enlarge the stroke space, so that a diameter d2 of the cylinder boreholes 5' results, which is larger than diameter d1 prior to machining. Side walls 6' of cylinder boreholes 5' now have a wall thickness w2, which is smaller than wall thickness w1 (FIG. 2*b*). Wall thickness w2 is so small that the support surface for the cylinder head gasket made available by upper side 7' of side walls 6' is so small that the cylinder head gasket no longer sits perfectly and a sufficient seal is no longer assured.

Cylinder boreholes 5' were milled along the upper sides 7' of side walls 6', so that they are shortened relative to wall 3 of housing 2. Side walls 6' thus have only a height h2, which is smaller than height h1 prior to machining. The difference in height between side walls 6' after machining and side walls 6 before machining is denoted h3 (FIG. 2*b*).

Engine block 1' need not be produced only by post-machining of an already cast engine block 1, but may, of course, also be cast directly in a mold.

Figure 3:
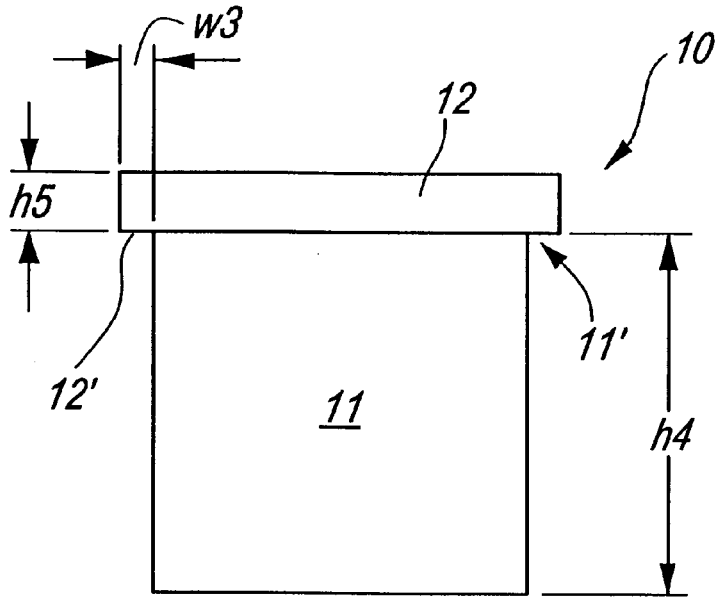
FIG. 3 shows a schematic side view, not drawn to scale, of a cylinder bushing according to the invention.

FIG. 3 shows the side view of a cylinder bushing 10 for use in the engine block 1' shown in FIG. 2*a* or 2*b*. The cylinder bushing 10 has a sleeve 11. A collar 12 runs around the upper end 11' of sleeve 11. The outer diameter of sleeve 11 corresponds to the inner diameter d2 of cylinder borehole 5', while the outer diameter of the collar is larger than the outer diameter of the sleeve. Sleeve 11 has a height h4, the magnitude of which [corresponds] to that of height h2 of the machined cylinder borehole (FIG. 2*b*). Collar 12 has a height h5, whose magnitude corresponds to that of the height difference h3 between the machined cylinder borehole 5' and the original cylinder borehole 5 (FIG. 1*b*). The width w3 of underside 12' of collar 12 results from the difference in the outer diameter of collar 12 and sleeve 11 and is larger than wall thickness w2 of the machined side walls 6' of cylinder boreholes 5 (FIG. 2*b*). Thus an enlarged support surface is available for the cylinder head gasket. The width w3 of underside 12' of collar 12, however, should be dimensioned such that it corresponds at least to wall thickness w2 of the machined side walls 6' of cylinder boreholes 5', in order to assure a sufficiently large support surface for the cylinder head gasket.

Figure 4:
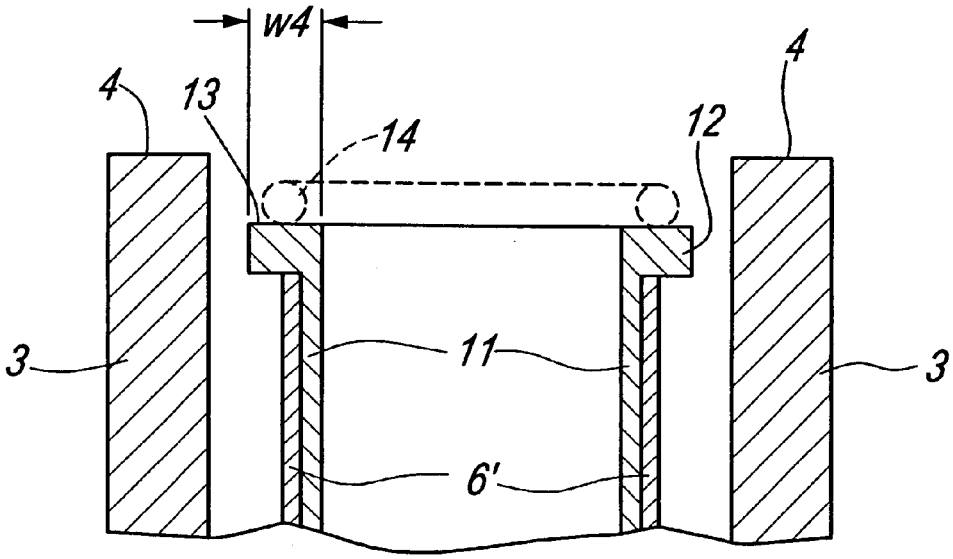
FIG. 4 shows a section through an engine block according to the invention corresponding to FIG. 2*b* with inserted cylinder bushing.

A section through the machined cylinder borehole 5 with inserted cylinder bushing is shown in FIG. 4. It is seen that underside 12' of collar 12 sits on upper side 7' of side walls 6', so that cylinder bushing 10 sits solidly in cylinder borehole 5'. Upper side 13 of collar 12 has a wall thickness w4, the magnitude of which results by addition of wall thickness w3 of underside 12' of collar 12 and the wall thickness of sleeve 11. Thus, a sufficiently large support surface is available for the cylinder head gasket 14 indicated by the dashes, so that the cylinder head gasket sits perfectly and assures a sufficient seal. The underside 12' of collar 12 should thus seal, however, at least flush with the side surface of side wall 6' of the machined cylinder borehole 5' (w4= wall thickness of the sleeve plus wall thickness w2 of the machined side walls 6'), so that a sufficiently large support surface is assured for the cylinder head gasket.

What is claimed is:

1. The combination of an engine block of a metal material for a multicylinder internal combustion engine and a plurality of cylinder bushings, said engine block having a housing, in which a plurality of cylinder boreholes are provided, whereby the outer surfaces of side walls of said cylinder boreholes are distanced from a wall of said housing, so that cooling channels arranged between said wall and said cylinder boreholes result, each of said cylinder bushings being inserted into a corresponding one of said cylinder boreholes, wherein the height of the cylinder boreholes is smaller than the height of the cylinder bushings.

2. The combination as claimed in claim 1 wherein each of said cylinder bushings has a sleeve and a collar, the outer diameter of said collar being larger than the outer diameter of said sleeve.

3. The combination as claimed in claim 2 wherein the difference between the outer diameters of said collar and said sleeve for each of said cylinder bushings is at least as great as the thickness of said side walls of said cylinder boreholes.

4. The combination as claimed in claim 3 wherein the outer diameter of each of said sleeves is equal to the inner diameter of said cylinder boreholes and wherein each of said sleeves has a height equal to the height of the side wall of the cylinder boreholes.

5. A method of making an engine block for a multicylinder internal combustion engine, said method comprising the steps of:

(a) forming a finished housing, said finished housing comprising a plurality of cylinder boreholes, each of said cylinder boreholes having a side wall the outer surface of which is distanced from a wall of said housing so as to create cooling channels between said wall and said cylinder boreholes, each of said cylinder boreholes having a height and each of said cylinder boreholes being adapted to receive a cylinder bushing; and (b) then, shortening the height of each of said cylinder boreholes.

6. The method as claimed in claim 5 wherein said finished housing is made of a metal material and wherein shortening step is performed by metal-cutting machining.

7. The method as claimed in claim 5 wherein the side wall of each of said cylinder boreholes has a thickness, said method further comprising the step of reducing the thickness of the side wall of each said cylinder boreholes.

* * * * *